US009816305B1

(12) United States Patent
Miller et al.

(10) Patent No.: US 9,816,305 B1
(45) Date of Patent: Nov. 14, 2017

(54) MULTI-INPUT MODULE FOR MOTORIZED GATE AND DOOR OPERATORS

(71) Applicant: Miller Edge, Inc., West Grove, PA (US)

(72) Inventors: Bearge Miller, West Chester, PA (US); Daniel G. Lasley, West Chester, PA (US); Timothy Castello, West Chester, PA (US); William Kalin, Peach Bottom, PA (US)

(73) Assignee: Miller Edge, Inc., West Grove, PA (US)

( * ) Notice: Subject to any disclaimer, the term of this patent is extended or adjusted under 35 U.S.C. 154(b) by 0 days.

(21) Appl. No.: 14/999,869

(22) Filed: Jul. 12, 2016

Related U.S. Application Data

(60) Provisional application No. 62/231,860, filed on Jul. 17, 2015.

(51) Int. Cl.
*E05F 15/42* (2015.01)
*E05F 15/43* (2015.01)

(52) U.S. Cl.
CPC ..... *E05F 15/43* (2015.01); *E05F 2015/434* (2015.01); *E05Y 2400/445* (2013.01); *E05Y 2400/54* (2013.01); *E05Y 2900/106* (2013.01)

(58) Field of Classification Search
CPC ..... E05Y 2800/70; E05Y 2900/106; E05Y 2400/54; E05Y 2400/445; E05F 15/42; E05F 15/43; E05F 15/40; E05F 15/72; E05F 15/73; E05F 15/74; E05F 15/00; E05F 2015/434
USPC ..... 49/25–29, 199, 200
See application file for complete search history.

(56) References Cited

U.S. PATENT DOCUMENTS 5,406,179 A * 4/1995 Davall ..... E05F 15/42 318/266
6,469,464 B1 * 10/2002 McCall ..... E05F 15/79 318/245
6,662,848 B2 * 12/2003 Goodman ..... E05D 15/26 160/1
7,066,297 B2 * 6/2006 Goodman ..... E05D 15/26 160/84.02
8,261,491 B2 * 9/2012 Yulkowski ..... E05F 15/00 49/25

(Continued)

*Primary Examiner* — Justin Rephann
(74) *Attorney, Agent, or Firm* — Robert B. Famiglio; Famiglio & Associates

(57) ABSTRACT

A system and method which allows automatic recognition of any of three common monitored motorized door or gate safety edges or other entrapment protection devices. The invention allows retrofitting existing motorized door operators without enough monitored input ports to allow for more monitored entrapment devices required on laterally moving motorized gates. The system interfaces with obstruction monitoring devices in normally closed, pulsed, or resistive termination operating environments found in entrapment protection systems. Firmware logically analyzes the state of each edge or entrapment protection device to select and direct an appropriate output signal for a motorized gate operator. An operational example is disclosed which provides for up to six different device inputs and two separate outputs for the motorized door operator, which can be configured through dual inline package switches allowing field configuration.

2 Claims, 2 Drawing Sheets

(56) References Cited

U.S. PATENT DOCUMENTS

| | | | | |
|---|---|---|---|---|
| 8,769,878 | B1 * | 7/2014 | Miller | E05F 15/43 49/199 |
| 8,984,809 | B1 * | 3/2015 | Miller | E05F 15/43 49/199 |

* cited by examiner

MULTI-INPUT MODULE FOR MOTORIZED GATE AND DOOR OPERATORS

CROSS REFERENCE TO RELATED APPLICATIONS

The Applicants claim the benefit of provisional patent application No. 62/231,860 filed on Jul. 17, 2015.

BACKGROUND OF THE INVENTION

1. Field of the Invention

The invention relates to an electronic control system and method of operation for an automatic motorized gate operator. The invention provides for connection of a plurality of switching safety edges and photo eye obstruction detection systems to control a motorized gate operating unit which has fewer monitored control inputs than the number of monitored edges required in an application.

2. Description of the Related Art

Motorized doors and gates are used for everything from residential garages to industrial moving, rolling or sliding doors and gates. In this disclosure, any reference to the term "gate" or "gate systems" also applies to "door" or "door systems." For many years, it has been a best practice and frequently a legal safety requirement to provide an obstruction protection mechanism to stop a motorized gate moving along a given track when the gate has an obstruction that will strike the gate if the motor driving the gate is not stopped. Many automatic doors or gates, particularly those such gates used in industry, have a gate operating unit which controls the power to the motor to open or close the motorized gate along its normal path.

The most common devices used to detect obstructions are photo beams and safety edges. Photo beams monitor a continuous path between a light emitter and a light receiver. Constant presence of the light beam between the transmitter and receiver signals no obstruction in the path, and an interrupted beam would indicate an obstruction or possibly failed sensor. It is desirable in monitored systems to recognize either event. Likewise, safety edges are switching devices placed along leading edges of moving doors or gates which change switching states upon obstruction contact to any portion of the switch.

To detect a fault in the switch as a fail-safe requirement, the switch is monitored to confirm continuity of the switch as a closed circuit. Upon activation from contact with an obstruction, the switch changes electrical state. Typical normal state continuity resistance is set to ten thousand ohms ("10KΩ"). Compression of typical edge switches along its length measures a short circuit and an open circuit measurement signals a fault in the edge or the associated wiring.

Monitoring for safety by detecting obstructions in the path of gates or moving doors is not new, but changes in safety regulations or best practices have required new methods of monitoring and an evolution in hardware to do so. There are recent changes in recognized standards for monitoring motorized gates in particular. Underwriters Laboratories® ("UL") and the American Society for Testing and Materials® ("ASTM") are the most well know examples of standard promulgating entities that have presented a need to increase monitoring of the number of possible entrapment areas in a moving gate.

A new UL 325 standard is a safety standard for door, drapery, gate, louver, and window operators and systems. Specifically, it applies to electric operators for doors, draperies, gates, louvers, windows and other opening and closing appliances. Similarly, ASTM F2200 is a standard that pertains to automated vehicular gates. ASTM F2200 recognizes five gate classifications: horizontal slide, horizontal swing, vertical lift, vertical pivot, and overhead pivot. UL325 was updated to require additional obstruction detecting devices for most gate installations. These updates became effective Jan. 12, 2016. The present disclosure relates to a system that addresses a need to interface more edge and obstruction monitoring sensors using existing gate operators which have less sensor inputs than the number of sensor required.

In the case of a garage door, a photo beam can detect the presence of an obstruction near the floor, while a safety edge can detect obstructions anywhere along the path of travel. The entrapment area is always the door opening, and is only of concern when the door is moving in the closing direction. A garage door closing may contact an obstruction or hazard on the way down, closing a switch when contacted the obstruction. Photo eye beams break continuity when the obstruction is present breaking the beam.

Alternately, a gate installation will likely have multiple entrapment areas, each of which may need to be guarded by entrapment protection devices. These entrapment zones may be further complicated as both directions of travel (opening and closing) need to be considered. Examples of the applications to which the invention is applied are found in standards publications such as an application drawing found at DASMA ASTM F2200. In the most complicated case, six entrapment detection devices may be required to guard all of the entrapment zones of a motorized gate.

In motorized, moving gate systems particularly, the direction of travel of the moving gate, laterally in relation to the ground in most instances, requires protecting several different areas around the gate to sense obstructions. Typically both edge sensors and photo eye type sensors are employed. With motorized gates, more than one of each type sensor is needed to protect up to four or five areas, such areas of the gate traveling in a reversible lateral direction. Leading and trailing edges of a gate need be protected and the gate movement area in each instance also need be protected from obstruction before an edge switch might contact an obstruction. Similar situations exist for swing gates and vertical lift gates. An interface device is needed to provide for such multiple inputs from safety edge or obstruction devices protecting a moving or motorized gate.

Accordingly, a device and method is needed in which the user of a motorized gate safety sensing system can use multiple sensor inputs ranging from edge sensing switch devices to photo eye devices commonly used in the industry. A system which allows retrofitting of existing gate operating units which provide for fewer sensor inputs than required for a multi sensor application would be useful. Such a conversion must maintain the safety conditions afforded by monitoring the operational readiness of the several switching edge protection devices while also monitoring multiple photo eye sensors, all controlling the same door operator.

It is the object of the present invention to provide an interface device which will allow a motorized gate operating unit to accept the application of a plurality of edge or area protecting devices without changing or modifying an existing gate operating unit which does not provide for a sufficient number of inputs. The disclosed invention could be used in new installations or to update existing installations.

It is further the object of the present invention to provide a conversion device to allow a motorized gate operator with a limited number of inputs to accept inputs from more device controlling or protecting gate edges in each operational direction by the door operating unit.

It is also the object of the present invention to provide a method of retrofitting an existing installation of a motorized gate or door with obstruction protection having a motor controller with insufficient input ports to accommodate multiple sensor edges and photo-eye type protective devices.

It is a further object of the present invention to accept multiple devices each of which use different signaling technologies and all of which require monitoring without the requirement of changing the controller or applying different power requirements.

SUMMARY OF THE INVENTION

The Underwriter's Laboratory® ("UL") standard for safety entrapment devices used on commercial doors and gates sets standards to enhance the safety of the public when using such motorized doors. While compliance to the standard is voluntary, the majority of commercial door and gate operators have modified their products in order to be in compliance with the new standard, considered best practices in the industry.

The most significant change to the standard requires gate operators, sometimes also referred to as gate controllers, (the mechanical linkages, motors and control circuits) to have at least one "monitored" external entrapment device. The term "monitored" defines a device that generates a unique signal such that the monitoring equipment, i.e. the operator, can determine that the device is connected and working properly. A monitored entrapment device for motorized gates therefore applies a fail-safe protocol to assure that the safety device itself is always operational, and stops the system if the safety device reports a failed condition of the device. Current best practices include protecting a motorized gate or door at multiple locations for each direction of travel.

Since motorized gates present possible hazards when opening and closing, use of multiple edge protection switching devices as well as photo eye obstruction devices may require four or five inputs to a motor controller for a single application. Different types of edge protection devices use different operational technologies and signaling characteristics. Though it is possible to design a motor door operator or controller which would provide input ports all of which are designed to monitor each separate protection device, a typical motorized gates controller may have only one or two inputs, typically one for each direction of travel. If five or six edge protection devices are used in a given installation, monitoring each protection device and controlling the gate operator becomes an issue.

In order to solve this problem, it would be desirable to have a multi-input interface device for motorized gates operators that would allow monitoring of multiple edge or area protection devices, switches or photo eye, but connect to an operator with less inputs than required for the gate or door being protected. The optimum design would be a system or device consisting of apparatus which serves as a solution to the described problem. Both a method and a system of retrofitting existing installations would be very advantageous.

In summary, the apparatus and method described both monitors a plurality of door or gate switch edge for its termination and checks the edge for activation. The invention controls a motorized door or gate operator with fewer than the required input ports in the same fashion as if the control provided adequate ports for monitoring many different protection edge devices including photo eye area monitoring. A firmware program operates a typical microprocessor to run through a learning mode to poll the edge devices and learn the signaling characteristics of each type connected. For each type of device, an output port can be selected by the user.

A failed termination device or other change of the electrical conditions of the switch because of failure or an activation of the switch result in the loss of signal to the operator and the door or gate stops and/or opens depending on the programmed set up of the door operator. The invention is a field replacement system for an existing switching edge and/or photo eye monitored automatic gate which functions with the existing monitored gate operator.

DETAILED DESCRIPTION OF THE INVENTION

Figure 1:
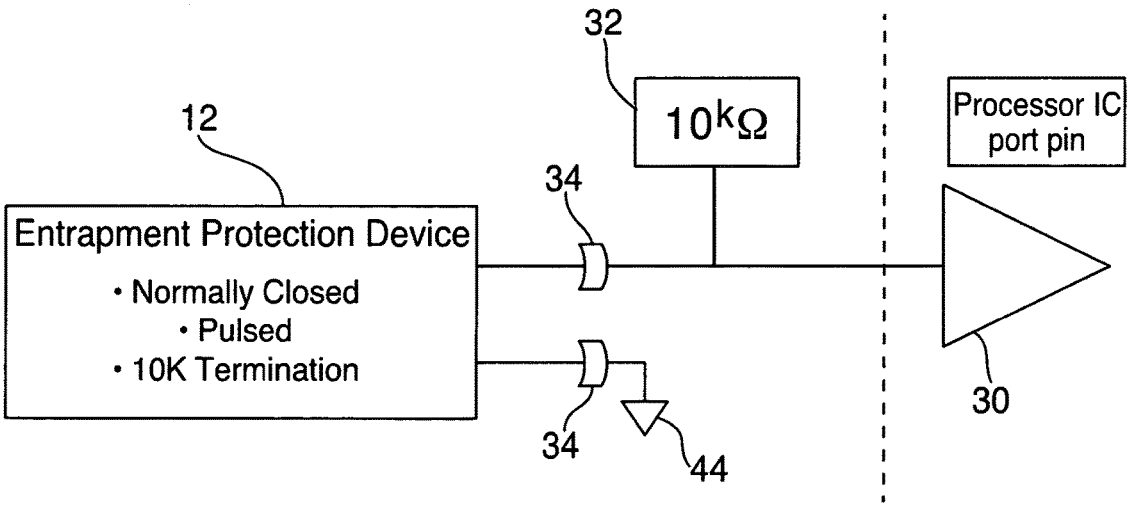
FIG. 1 is a block diagram illustrating available input configuration of a typical device used for one of the inputs of the invention.
Figure 2:
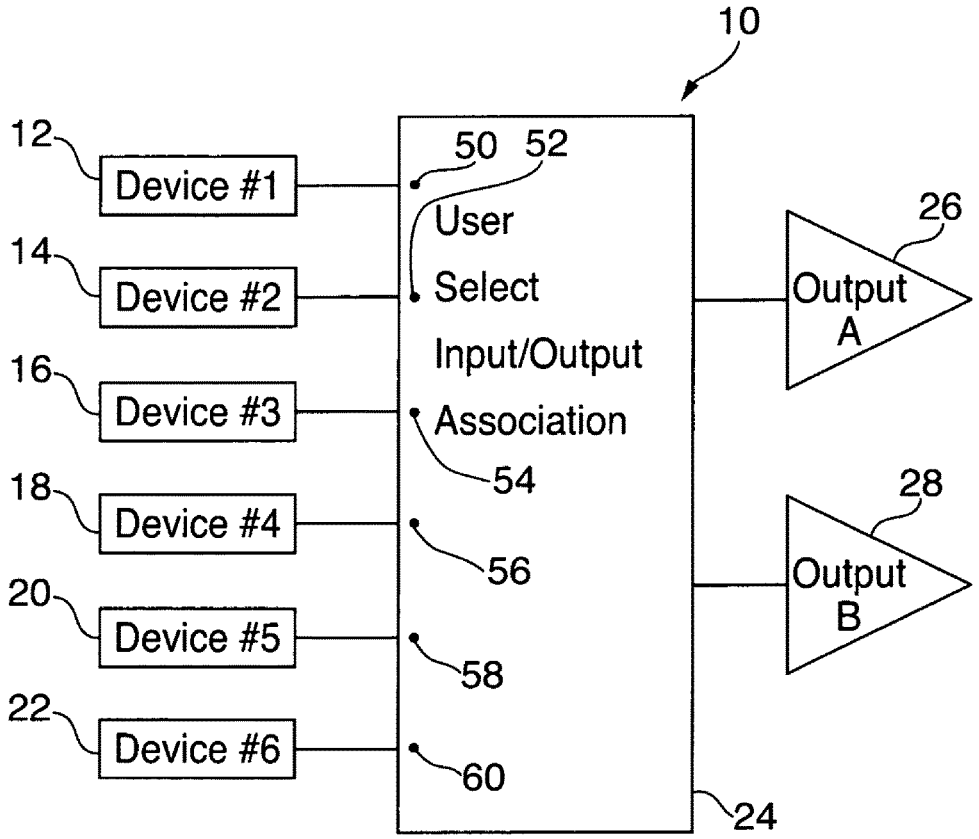
FIG. 2 is a block diagram illustrating a typical configuration for use of the invention with different entrapment protection device formats and the six device input ports which can be associated with two separate outputs ports.

The general description of the Multi-Input Module ("MIM") provided below may be considered with reference to the Figures in which like numerals relate to like parts. FIG. 1 is a block diagram of one entrapment protection device used with the invention. FIG. 2 is a block diagram of the invention's architecture demonstrating connection of two or more devices to the invention with at least two output ports for connection to a motorized door or gate operator. The example presented has six inputs for entrapment protection devices and two outputs to a motorized gate (or door) operator. Though not widely needed, it can be appreciated that more than two outputs ports can be configured in an embodiment. In general, any combination where there are more devices than operator control inputs can use the invention. An embodiment of the invention made strictly for the motorized door industry might only have two inputs and one output. However, motorized gates now require more devices for suitable entrapment protection.

Most current gate operators do not have enough inputs to accept more than one or two devices in each direction. The current UL 325 requirements may create situations where more devices are required than can be accepted by the operator. The present disclosure will make it possible to connect more devices. The invention also accounts for unused inputs in the event less than all the inputs are actually used in a given installation. In the preferred embodiment shown in FIG. 2, there are six universal input ports for up to six entrapment sensing devices 12, 14, 16, 18, 20 and 22. These will accept normally closed ("NC"), pulsed, and resistor terminated devices. Each input can be associated with either of the two outputs 26 or 28. The outputs can be set for resistor terminated, pulsed or NC mode each of which will have different characteristics for a motorized gate operator. The invention is housed in a metal chassis which is intended to be mounted inside the chassis of a gate operator.

As to requirements for a power supply, this device will be connected to the standard operator voltages (typically 12 VDC to 24 VAC). DC power can be available to the accessory devices. Each input port will have four connections: two for power 42 and 36 and two for signal out from the entrapment sensing device 38 and 44. A 10KΩ pull-up resistor 32 is sufficient for the NC and pulsed logic levels, and provides the range needed to monitor a resistor termination via an analog to digital converter. There is one LED associated with each input to indicate operation.

The outputs 26 and 28 will be either opto-relays or mechanical relays. They can be selected as either NC, resistor terminated or pulsed (independently), via a dual inline package) ("DIP") switch selected by the user, or other user input selection methods. There is an LED for each output that indicates a fault mode. Each input can be assigned to either output A 26 or B 28. This will be done via a DIP switch in the user selectable input/output association 24. FIG. 2 discloses the relationship of each entrapment device to the MIM inputs 50 through 60 inclusive.

After installation of the preferred embodiment and it is configured properly and there are no faults from any of the devices, the installer can initiate a sequence to execute a program in firmware which will examine each input 12, 14, 16, 18, 20, and 22 to determine which type of device is connected to a given input: NC, pulsed, resistive, or absent. A status LED can be configured to blink to indicate that this is in process. Once complete, the input channel information determined by the firmware routine will be stored in an EEPROM and normal operation will begin. Prior to this configuration procedure, the outputs 26 and 28 will be in a fault mode, and the microprocessor will continuously scan the inputs to assist the installer with the setup.

During a learn mode, any input that is near Vcc/2 will be considered a resistive termination, in the United States typically 10KΩ is used. With configured firmware set up to do so, any input that is HI for 10 ms will be considered not connected. The remaining inputs will be examined for pulsed or NC. During normal operation, any active input that is HI for more than 10 ms will be considered in fault. If a resistive input is LO, it will be considered a fault.

There are two aspects of the innovation in the MIM disclosed as a preferred embodiment. The first is an input design that allows for automatic recognition of any of the three common monitored input interfaces: normally closed, pulsed, and a typical 10KΩ termination. The invention takes advantage of the flexibility found in many microprocessors which allows a single pin to be configured as an analog or digital input. This allows the invention to identify and monitor the three different types of interfaces with a single set of hardware. As described above, the invention can also detect whether a device is not connected or is faulty.

The second aspect of the invention is using computer firmware in a microprocessor to logically detect the type of each device and then to generate an appropriate output signal for the gate operator. The output signal will report a fault condition if any of the inputs are in fault. Restated, in order to report a "good" condition to the operator, every input must also report a "good" condition.

In the preferred embodiment, the invention provides for up to six device inputs and two outputs for the operator. The user can associate the inputs with the outputs via DIP switches. Also, the user can select one of two output formats via different DIP switched. For example: an installation may require five entrapment protection devices, two in the gate close direction and three in the gate open direction. Reference is made to FIG. 2 and the example presented below. The installation table would present as follows:

| Input # | Device Type | Location | Output A/B |
|---|---|---|---|
| 1 | Normally Closed | Photo-eye (Close) | A |
| 2 | Pulsed (Wireless switch) | Leading edge (Close) | A |
| 3 | Normally Closed | Photo-eye (Open) | B |
| 4 | 10K Edge | Draw-in post edge (Open) | B |
| 5 | Pulsed (Wireless Switch) | Trailing edge (Open) | B |
| 6 | Not used | | |

The User would set the DIP switch to associate channels 3, 4, and 5, (16, 18, 20) to Output B 28. After executing a learn firmware routine, the MIM would recognize that Input 6 (22) is not used.

Every input has a 10K pull-up resistor 32 and is connected to an analog-to-digital converter ("ADC") within microprocessor 25. Firmware which operates microprocessor 25 checks each input to determine if the observed voltage is HI, LO, or in the Middle. If the device connected to the input has a 10KΩ resistance to ground, it will read in the Middle. The MIM firmware is configured to have two modes: learn and run. The first time the invention is powered-up, it defaults to learn mode. In learn mode, each input is checked for HI, LO, or Middle. If the input reads Middle, it is assigned as a 10KΩ device. If the input is LO, it is assigned as a Normally Closed device. If the input is HI, it is assigned as No Connect. These inputs are checked several times, and if an input toggles between HI and LO, it is re-assigned as a pulsed device. When all of the external devices are connected and configured to be in a good (functioning) state, the user will press a learn button (or a software command, or other user input method). These settings will be saved into non-volatile memory, ("saved mode"), and then the MIM will go into the beginning of run mode.

Figure 3:
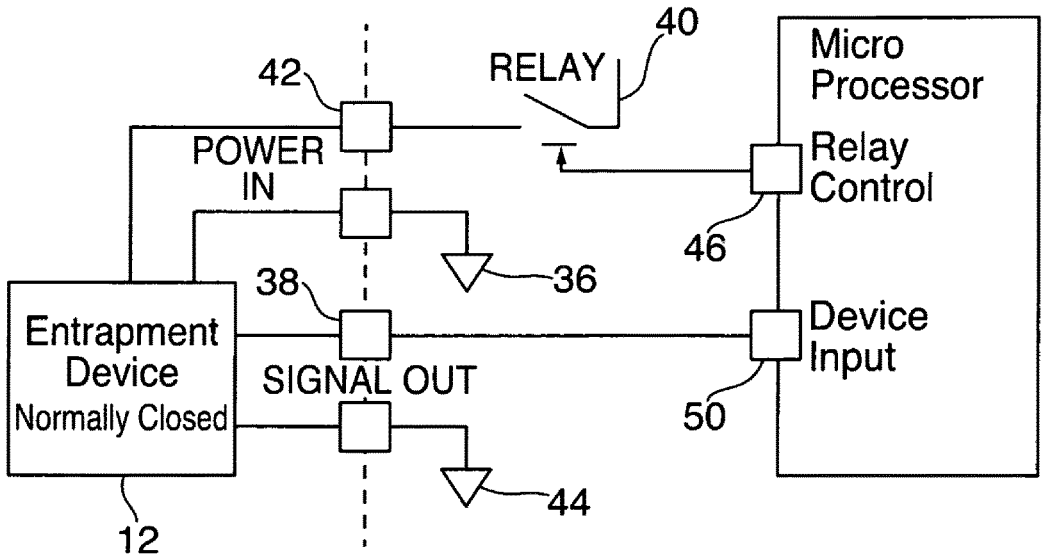
FIG. 3 is a block diagram of an auxiliary relay used to control power to a typical normally closed monitoring device used with the present invention.

In run mode, the MIM repeatedly checks each input against the set up parameters entered in the saved mode. On power-up, certain extra steps are required for the normally closed interface. To confirm the presence of this type of device, an auxiliary relay 40 is used to control the power to the devices. This type of relay 40 to power input devices is shown in FIG. 3. Relay control is part of the operating firmware and processor 25 can activate relay 40 though relay control pin 46 as shown.

First, this power is kept off (relay open) and each normally closed device input is checked to make sure it reads HI, indicating that the external device is in fault mode (open). If any of these inputs read LO (short), an error is flagged, as the external device is considered faulty. The MIM is configured to stop at this point, and no further actions will occur.

If all of the normally closed inputs read HI, then the auxiliary relay 40 is closed, providing power to devices 12, 14, 16, 18, 20 and 22. Normal operation continues at this point, where any LO signal is considered good, and any middle or high signal is considered Fault. The pulsed and 10KΩ termination inputs do not do anything special on power-up. For 10KΩ devices, any input that is HI (disconnected) or LO (active) is considered a fault.

For pulsed devices, the input state must change from HI to LO, or LO to HI within a defined period (usually 10 ms). If the state does not change in this period, it is considered a fault. Note that in all cases, a missing external device will cause a continuous HI input, which will be reported as a fault. Inputs marked as not used are ignored. In the preferred embodiment, a method is provided to allow for reconfiguration through user inputs by selecting the learn mode. It can be appreciated that this procedure can be made to be complicated enough that a user cannot easily disable the input to a device inadvertently.

Although the invention has been described in accordance with the preferred embodiment, it will be appreciated by those skilled in the art that the application of the present invention is useful in a variety of configurations and designs not specifically described above. All such designs and applications are considered to be within the scope of the present disclosure, and the invention is applicable across a wide variety of applications. Such applications are considered within the scope and spirit of the present invention. In so far as the description above and the accompanying drawings disclose any additional subject matter that is not within the scope of the claims, the inventions are not dedicated to the public and the right to file one or more applications to claim each such additional inventions is reserved.

What is claimed:

1. An interface between multiple monitored obstruction sensing devices of two or more signaling characteristics, said two or more signaling characteristics being resistive termination, normally closed or pulse type obstruction sensing and a motorized gate operator with fewer sensing device inputs than required for a given application, the interface comprised of:

at least two input ports configured to connect to at least two monitored obstruction sensing devices, each input port configured for automatic recognition of any of either said resistive termination, normally closed, or pulsed obstruction sensing devices;

at least one output port configured to connect with at least one input on said motorized gate operator in which each said at least one input is adapted to either a resistive termination, normally closed or pulsed sensor signaling characteristic;

whereby the interface is programmed to recognize the signaling characteristics of each said sensing device and route each said sensing device according to the at least one output port which is configured for said signaling characteristic of said motorized gate operator.

2. The apparatus of claim 1 further including means to select the signaling characteristics association between each said input port and one of two or more said output ports configured to connect with at least one said input on said motorized gate operator.

* * * * *